US009072390B2

(12) United States Patent
Poppe

(10) Patent No.: US 9,072,390 B2
(45) Date of Patent: Jul. 7, 2015

(54) METHOD FOR MANUFACTURING A FOAM SPRING FOR PILLOW, CUSHION, MATTRESSES, OR THE LIKE

(75) Inventor: Willy Poppe, Sint-Niklaas (BE)

(73) Assignee: Elisana S.A.R.L., Luxembourg (LU)

( * ) Notice: Subject to any disclaimer, the term of this patent is extended or adjusted under 35 U.S.C. 154(b) by 880 days.

(21) Appl. No.: 11/894,450

(22) Filed: Aug. 21, 2007

(65) Prior Publication Data

US 2009/0049615 A1 Feb. 26, 2009

(51) Int. Cl.
*A47C 27/06* (2006.01)
*B26D 3/10* (2006.01)

(52) U.S. Cl.
CPC ..... *A47C 27/063* (2013.01); *B26D 3/10* (2013.01); *Y10T 156/1026* (2015.01); *Y10T 156/1038* (2015.01)

(58) Field of Classification Search
None
See application file for complete search history.

(56) References Cited

U.S. PATENT DOCUMENTS

| | | | | |
|---|---|---|---|---|
| 5,705,252 | A * | 1/1998 | Lea et al. | 428/133 |
| 6,843,872 | B2 * | 1/2005 | Morman | 156/163 |
| 2005/0172468 | A1 | 8/2005 | Poppe | 29/91.1 |
| 2006/0282954 | A1 | 12/2006 | Poppe | 5/720 |
| 2007/0031211 | A1 * | 2/2007 | Schmidkonz | 412/6 |

FOREIGN PATENT DOCUMENTS

| | | | |
|---|---|---|---|
| BE | 878380 | | 2/1980 |
| BE | 1011070 | A3 | 4/1999 |
| EP | 0 624 332 | A1 | 11/1994 |
| EP | 0 762 011 | A1 | 3/1997 |
| EP | 0 793 932 | A1 | 9/1997 |
| EP | 0 872 198 | A2 | 10/1998 |
| EP | 1 046 365 | A1 | 10/2000 |
| WO | WO 2005/020761 | A1 | 3/2005 |
| WO | WO 2005/074752 | A1 | 8/2005 |
| WO | WO 2007/003018 | A1 | 1/2007 |
| WO | WO 2007053035 | A1 * | 5/2007 |

* cited by examiner

*Primary Examiner* — Barbara J Musser
(74) *Attorney, Agent, or Firm* — Mitchell P. Brook; One LLP

(57) ABSTRACT

A foam spring for use in pillows, cushions, mattresses or the like, the foam spring having a tubular resilient body made of foam with holes extending inwardly from an outside surface to an inside location, wherein the holes extend at a non-perpendicular angle relative to a line perpendicular to the outside surface of the spring at the position of the hole. The foam spring is manufactured by a method which comprises providing interrupted slits along lines extending in the longitudinal direction of a foam layer; cutting a transverse strip out of this foam layer; bending two opposite ends of the strip towards each other; and fixing the two opposite ends into a tubular shape to form the tubular resilient body, wherein the slits are made in a direction forming an angle with the direction perpendicular to the surface of the foamed layer.

12 Claims, 5 Drawing Sheets

METHOD FOR MANUFACTURING A FOAM SPRING FOR PILLOW, CUSHION, MATTRESSES, OR THE LIKE

BACKGROUND OF THE INVENTION

1. Field of the Invention

The present invention concerns a foam spring in particular a foam spring with a tubular resilient body made of foam with holes extending inwards from the outside and which can be applied in the core of pillows, mattresses, armchair cushions or the like.

The invention also concerns a method of manufacturing such a foam spring.

2. Discussion of the Related Art

Such foam springs are known for example from US Published Patent Application No. 2005172468 and European Patent Document EP 0.872.198, disclosing a foam spring made out of a foam layer strip of for example latex or polyurethane foam, provided with slits, whereby the strip is bent and two opposite ends of the strip are glued together to form a hollow tubular body with diamond shaped holes formed by stretching the slits in a lateral direction due to the bending of the strip.

With the known foam springs the slits in the foam layer extend in a direction perpendicular to the foam layer strip, resulting in a foam spring with holes extending in a direction perpendicular to the outside surface of the spring at the position of the hole.

Said slits are made for example using straight knives with a cutting motion perpendicular to the surface of the strip.

Such springs can have a cylindrical shape with radially extending holes or rather a bi-conical shape as disclosed in US Published Patent Application No. 2005172468 or a barrel shape as disclosed in European Patent Document EP 0.872.198.

SUMMARY OF THE INVENTION

It is an object of the present invention to provide a foam spring with improved properties for use in pillows, cushions, mattresses or the like.

To this end, the invention concerns a foam spring that is provided with a tubular resilient body made of foam with holes extending inwardly from the outside to the inside, wherein the holes extend in a direction forming an angle with the direction perpendicular to the outside surface of the spring at the position of the hole.

Such a foam spring has a different resiliency than known foam springs with holes extending in the radial direction or in a direction perpendicular to the outside surface of the spring at the position of the hole.

When used in pillows, mattresses or the like, the user experiences a great feeling of comfort.

These foam springs according to the invention can of course be combined with other types of springs in order to create different comfort zones with different softness in a pillow, mattress or the like.

In this manner, the pillow, mattress or the like can be personalised to the user's body shape and preferences.

Depending on the angle formed by the direction in which the holes extend with respect to the direction perpendicular to the outer surface of the spring, the spring can be made softer or firmer depending on the users needs. Also the spring gives a different feel of comfort to the user of the pillow, mattress or the like, whether the holes in the spring are oriented in a downward or upward or horizontal direction.

The invention also concerns a method for manufacturing such a foam spring, which method is mainly comprised of providing interrupted slits along lines extending in the longitudinal direction of a foam layer; cutting a transverse strip out of this foam layer; bending two opposite ends of the strip towards each other; and fixing both these opposing ends in order to form a tubular resilient body. The slits are made in a direction forming an angle with the direction perpendicular to the surface of the foamed layer.

Preferably the slits are formed by a cutting device with at least one cutting element that is provided on a rotatable shaft with a drive mechanism, whereby the shaft extends in a direction transverse to the longitudinal direction of the foam layer.

Such a rotating cutting device is very simple and allows in the use of the method in a continuous process for cutting slits in a continuous foam layer. It is advantageous to use a cutting disk with a plurality of cutting blades on its circumference with a length corresponding to the longitudinal length of the slits.

The form and dimensions of the disk and of the cutting blades can be adapted in order to obtain that the slits are automatically cut forming an angle with the direction perpendicular to the foam layer.

The angle of the slits can be varied depending on the diameter of the disk, the thickness of the foam layer and the form of the cutting blades.

BRIEF DESCRIPTION OF THE DRAWINGS

In order to better explain the characteristics of the invention, the following preferred embodiment of a foam spring and of a method according to the invention for manufacturing such a foam spring is described as an example only without being limiting in any way, with reference to the accompanying drawings, in which.

DESCRIPTION OF THE PREFERRED EMBODIMENT

Figure 1:
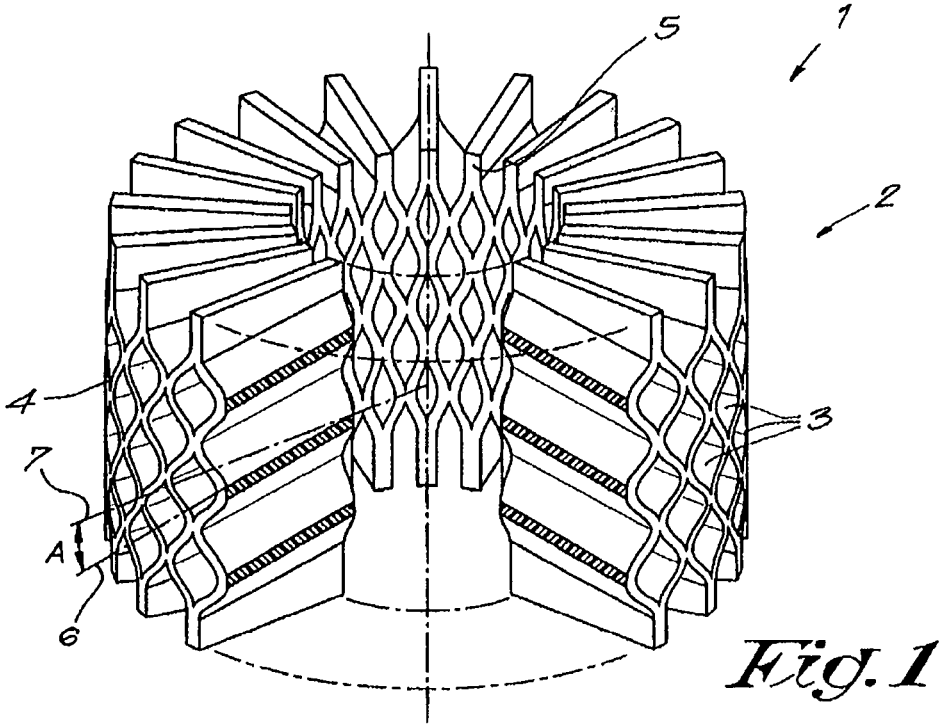
FIG. 1 represents a perspective view of a foam spring according to the invention.

The spring represented in FIG. 1 is a foam spring 1 for use in pillows, cushions, mattresses or the like, and is comprised of a tubular resilient body 2 made of foam with holes 3 extending inwardly from the outside surface 4 to the inside surface 5 of the spring 1, wherein the holes 3 extend in a direction 6 forming an angle A relative to a geometrical radius 7 extending from the longitudinal axis X-X' of the tubular body 2 perpendicularly to the outer or inner surface of the spring at the position of the hole 3. The angle A is preferably located in a radial plane extending through and including the longitudinal axis X-X' of the tubular body 2.

Figure 2:
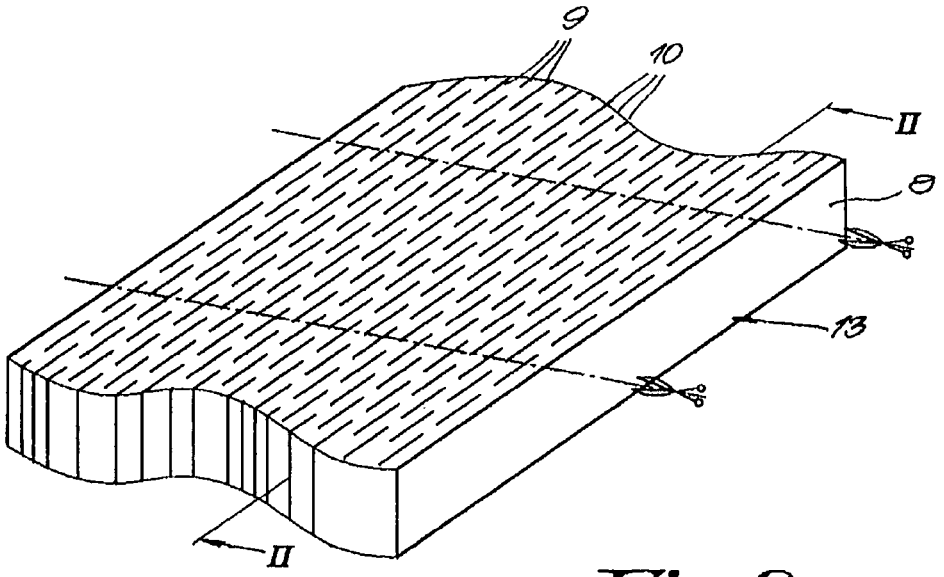
FIG. 2 represents a foam layer with slits used for manufacturing a foam spring according to the invention.

The foam spring 1 is made out of a foam layer 8 as represented in FIG. 2, with a series of slits 9 extending in the longitudinal direction Y-Y'.

The slits 9 in the foam layer 8 are cut along a plurality of interrupted parallel lines at a distance from each other.

The slits 9 are advantageously positioned according to a staggered pattern, whereby the slits 9 along adjacent lines 10 are offset in their longitudinal direction Y-Y', for example over a distance equal to half the longitudinal length of the slits 9.

In particular, the direction 11 of the slits 9 form an angle A with the direction 12 perpendicular to the surface of layer 8, whereby the slits 9 preferably extend in a plane perpendicular to the surface of the layer 8.

Figure 4:
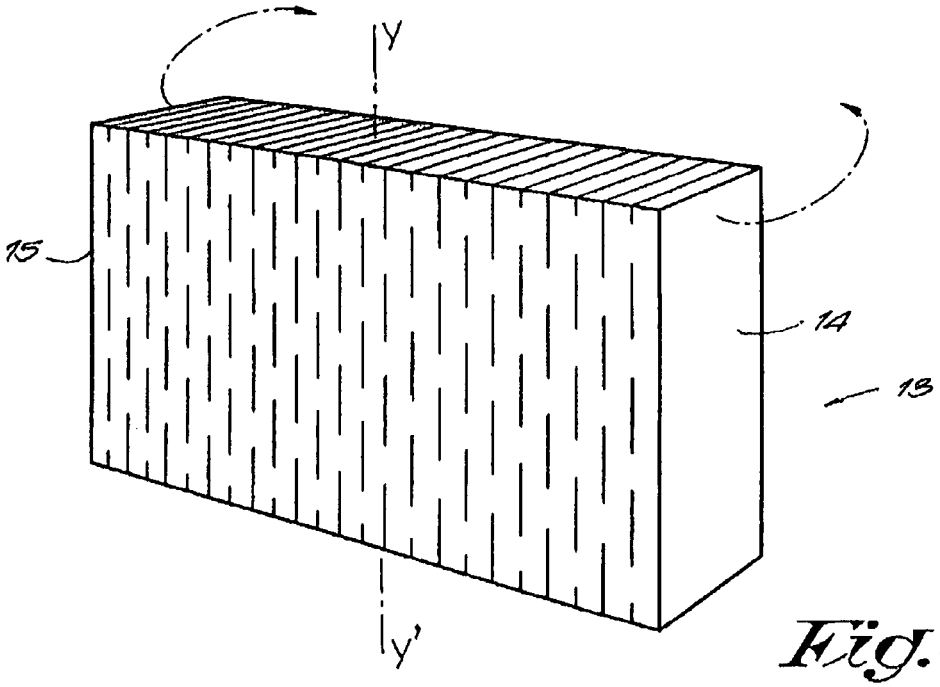
FIG. 4 is an illustration of using a foam layer strip for making a foam spring according to the invention.

As represented by the dotted lines in FIG. 2, the foam layer 8 is transversely cut in strips 13, each strip presenting two opposite ends 14 and 15 extending in the longitudinal direction Y-Y' of the slits 9, which opposite ends 14 and 15 are bent towards each other, as represented with the dotted arrows in FIG. 4, and are fixed together, by gluing or other technique, to form said hollow tubular body 2 of the spring 1 with holes 3 that are diamond like shaped by stretching the slits 9 in a transversal direction Z-Z' due to the bending of the strip 13.

Figure 3:
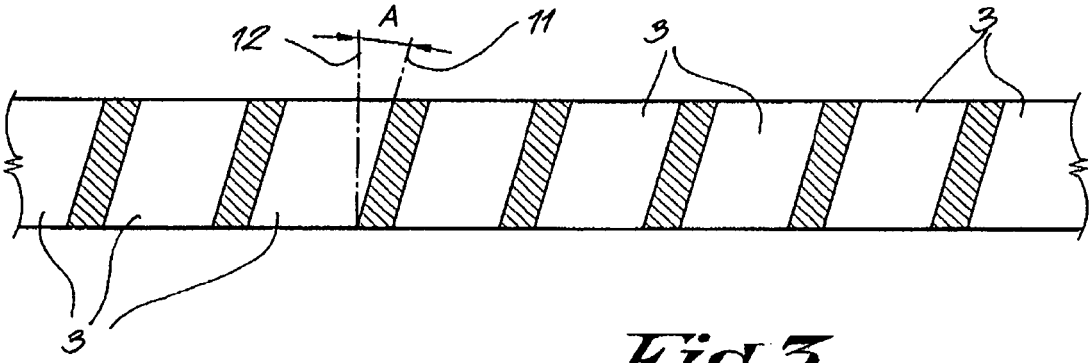
FIG. 3 is a cross-section according to line II-II in FIG. 2.
Figure 5:
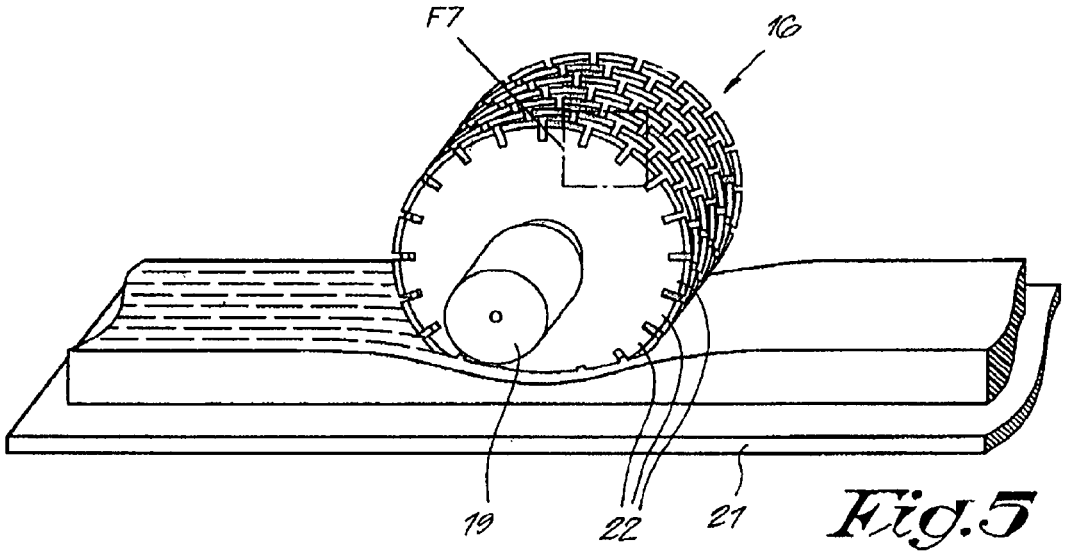
FIG. 5 illustrates the method of making a foam layer as represented in the FIGS. 2 and 3.
Figure 6:
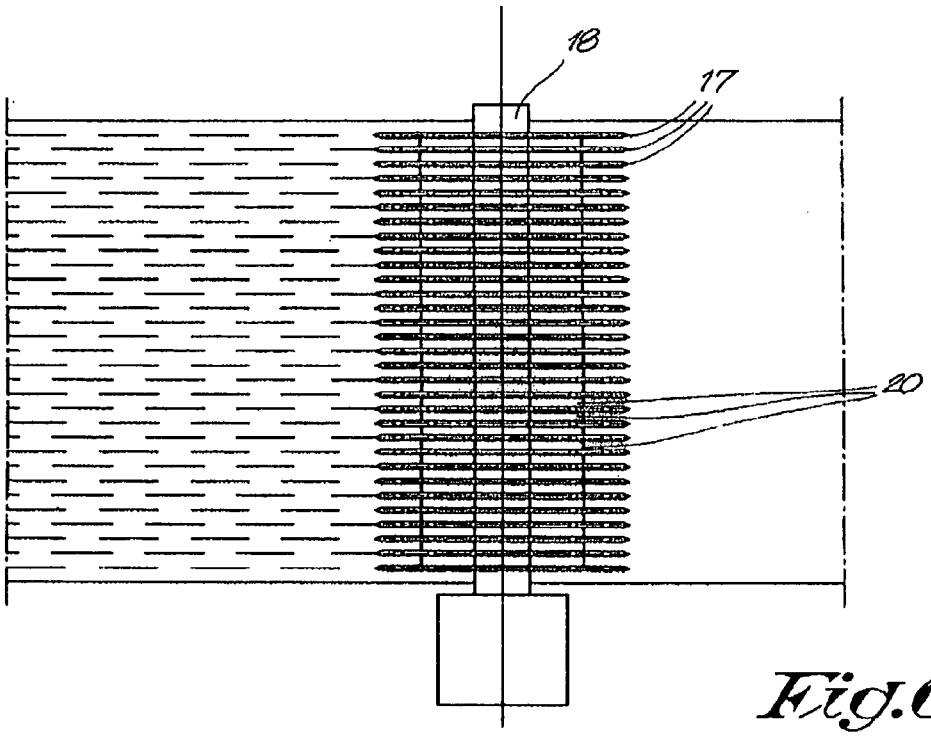
FIG. 6 represents a view following the direction indicated by F6 in FIG. 5.

FIGS. 5 and 6 illustrate a method of providing slits 9 in the foam layer 8 as represented in the FIGS. 2 and 3, in particular slits 9 that are cut in the plane perpendicular to the foam layer 8 and extending in a direction 11 forming an angle A with the direction 12 perpendicular to the surface of the foam layer 8.

In the example shown, the slits 9 are formed by a cutting device 16 in the form of a plurality of cutting disks 17 arranged on a rotatable shaft 18 with a drive mechanism 19 in the form of a motor or the like.

The disks 17 are separated from each other by spacers 20.

The cutting device 16 is provided above a transport table 21 forming a support on which the foam layer 8 to be provided with slits can move in the longitudinal direction.

The shaft 18 extends in a direction transversal to the longitudinal direction of the table 21 and of the foam layer 8.

Each of the disks 17 is provided with a plurality of cutting blades 22 with a length corresponding to the longitudinal length of the slits 9 to be cut.

The cutting blades 22 are provided with a cutting edge 23 which, in the case of the Figures, is formed by the circumference of the disk 17.

The cutting blades 22 of the two adjacent cutting disks 17 are rotationally shifted with respect to each other, for example over an angle corresponding to half the length of the blades 22.

When the cutting device 16 is activated by the driving mechanism 19, the cutting blades 22 cut into the foam layer 8 to form the rows or lines 10 of slits 9.

In order to get a clean cut, it is advantageous to provide longitudinal slits (not shown) in the table 21 in which the cutting blades 22 move during the rotation of the cutting device 16, these slits having a width mainly corresponding to the thickness of the cutting blades 22.

The diameter of the disks 17 and the thickness of the foam layer will determine the desired angle A of the slits 9 in the foam layer 8.

The smaller the diameter of the disks 17, the larger the angle A.

Figure 7:
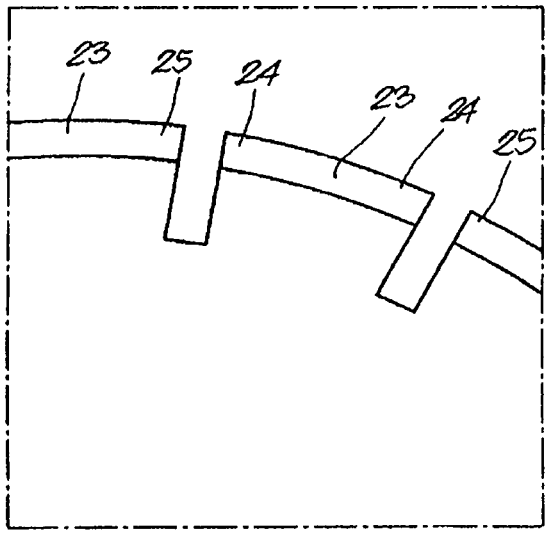
FIG. 7 represents on a larger scale the part which in FIG. 5 is indicated by F7.
Figure 8:
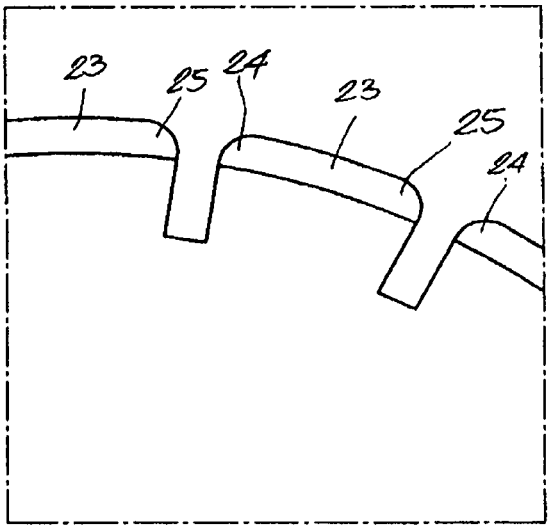
FIG. 8 is an illustration similar to that of FIG. 7 but for another embodiment.
Figure 9:
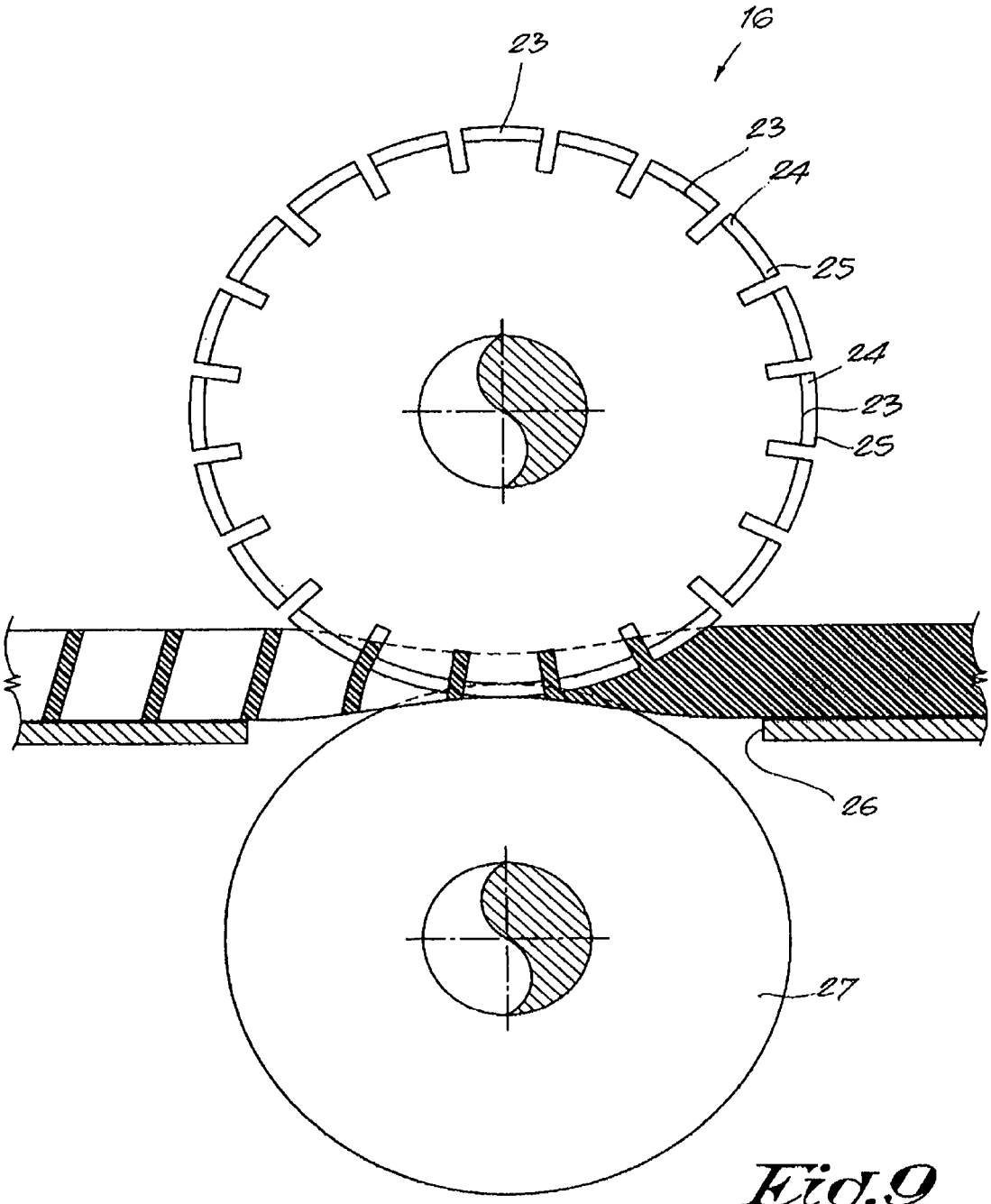
FIG. 9 represents a cross-section according to line IX-IX in FIG. 6, but for a different embodiment.

Although the tips 24 and 25 of the cutting edges 23 will normally be angled as shown in FIG. 7, the angle A of the holes can for instance be influenced by chamfering, filleting or rounding the tips 24 and/or 25 of the cutting blades as shown in FIG. 8, whereby filleting or chamfering will reduce the angle A because of the fact that the time that the cutting blades begin to cut in the foam layer 8 is retarded.

Another possibility is that the cutting edges 23 of the cutting blades 22 are not formed by the circumference of the disks 17, but that these cutting edges 23 are straight and slanting with respect to the radial direction.

By altering the angle A, it is clear that also the features of the foam spring will be altered, allowing this way to manufacture springs with different features, simply by changing the cutting device 16, in particular by changing the disks of the cutting device.

It is clear that the cutting device does not necessarily have to be assembled by using disks, but that the cutting device can also be formed by a drum with cutting blades, or in a simplified embodiment by only one cutting blade disposed on a rotating shaft.

Instead of providing slits in the table 20 in order to get clean cuts, an alternative method consists in providing a table 20 which is interrupted by an opening 26 underneath the cutting device, and providing a counter roll 27 co-operating with the cutting device 16, the foam layer 8 being introduced between the counter roll 27 and the cutting device 16.

The present invention is by no means limited to the above-described embodiments given as an example and represented in the accompanying drawings; on the contrary, such a foam spring and method for manufacturing such a spring can vary while still remaining within the scope of the invention.

What is claimed is:

1. A method of manufacturing a foam spring with a tubular resilient body comprising:

providing a foam layer having:

a first generally planar surface; and a second generally planar surface opposite the first surface;

wherein both the first and second planar surfaces have longitudinal and lateral dimensions;

providing a plurality of cutting blades, each having a cutting edge, the cutting blades arranged on the circumference of a cutting device;

providing a cutting surface opposite the cutting blades;

forming a plurality of slits extending from the first generally planar surface through to the second generally planar surface, extending between the first and second planar surfaces in a slanted direction forming an acute angle greater than zero degrees relative to a line perpendicular to the first planar surface by the feeding the foam layer in a lateral direction between the cutting blades and the cutting surface while the cutting device rotates, first laterally drawing the first generally planar surface by a first engagement with a leading edge of one of said blades, initiating the angled incision, and then fully forming the incision by continuously feeding the foam layer in the lateral direction until the incision extends through to the second generally planar surface.

2. The method according to claim 1, wherein the cutting device is provided on a rotatable shaft with a drive mechanism, whereby the shaft extends in a direction transverse to the longitudinal direction of the surface of the foam layer.

3. The method according to claim 2, wherein the cutting device is a cutting disk, and the length of each said cutting edge corresponding to the longitudinal length of the slits.

4. The method according to claim 3, wherein the cutting edges are positioned along a circumference of the disk.

5. The method according to claim 3, wherein the cutting disk co-operates with a counter roll, the foam layer being introduced between the cutting disk and the counter roll for cutting the slits.

6. The method according to claim 2, wherein the plurality of slits are cut simultaneously by the use of the cutting device.

7. The method according to claim 1, wherein each said slit has a slit angle, the angle determined by an amount of rounding or champfering of its respective cutting edge.

8. The method according to claim 1, wherein the cutting blades are arranged on adjacent cutting disks and are rotationally shifted over half a length of the blades.

9. The method according to claim 1, wherein the slits are made in a uniformly slanted direction forming a uniform angle in relation to the planar surfaces of the foam layer whereby the holes in the tubular resilient body extend to corresponding uniform orientation.

10. The method according to claim 1, further comprising:

cutting a transverse strip out of the foam layer, the transverse strip having two opposite transverse ends generally perpendicular to the first and second planar surfaces, and extending between the respective first and second planar surfaces, at least one of the slits extending in a generally lateral direction along the first planar surface and extending through to the second planar surface;

forming the transverse strip into a tubular body having an exterior tube surface and an interior tube surface generally concentric to the exterior tube surface by fixing the two opposite transverse ends with each other whereby the slits expand to define holes at least on the exterior tube surface and extending towards the interior tube surface, the slits extending depthwise from the exterior tube surface to the interior tube surface, the holes extending at acute angles relative to a geometrical radius of the tubular body.

11. The method according to claim 1, wherein the cutting device is a cutting drum, with plural rows of said cutting blades arranged along an outer surface of the drum.

12. A method of manufacturing a foam spring comprising:

providing a foam layer having a first generally planar surface, a second generally planar surface opposite the first generally planar surface, and two opposite transverse surfaces generally perpendicular to at least one of the first and second generally planar surfaces;

forming slits along interrupted lines extending in the lateral direction of the foam layer, the slits extending between the first and second generally planar surfaces of the foam layer in a longitudinally slanted direction forming an angle greater than zero degrees relative to a line perpendicular to the first planar surface, the slits extending fully through the foam layer from the first planar surface through to an opposing second planar surface;

fixing the two opposite transverse surfaces with each other forming a tubular body whereby the slits expand to form holes fully extending through the tubular body, from an exterior tube surface to an interior tube surface, the holes extending at acute angles relative to a geometrical radius of the tubular body.

* * * * *